US010793398B2

(12) United States Patent
Turek et al.

(10) Patent No.: US 10,793,398 B2
(45) Date of Patent: Oct. 6, 2020

(54) CONVEYANCE ELEMENT FOR A PEOPLE CONVEYOR

(71) Applicant: Otis Elevator Company, Farmington, CT (US)

(72) Inventors: Alexander Turek, Munchendorf (AT); Thomas Illedits, Neufeld an der Leitha (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/569,093

(22) Filed: Sep. 12, 2019

(65) Prior Publication Data

US 2020/0087117 A1 Mar. 19, 2020

(51) Int. Cl.
*B66B 23/12* (2006.01)
*B66B 29/02* (2006.01)
*B66B 23/10* (2006.01)

(52) U.S. Cl.
CPC ..... *B66B 23/12* (2013.01); *B66B 23/10* (2013.01); *B66B 29/02* (2013.01)

(58) Field of Classification Search
CPC ..... B66B 23/10; B66B 23/12; B66B 29/02; B66B 31/00
USPC ..... 198/333
See application file for complete search history.

(56) References Cited

U.S. PATENT DOCUMENTS 898,794 A * 9/1908 Seeberger ..... B66B 23/12 198/333
4,257,515 A * 3/1981 El Taher ..... B66B 29/00 198/333
4,565,276 A * 1/1986 Dengs ..... B65G 17/34 198/321
5,042,641 A * 8/1991 Soldat ..... B66B 31/003 198/333
5,295,568 A * 3/1994 Saito ..... B66B 29/02 198/330
5,918,722 A 7/1999 Behle
(Continued)

FOREIGN PATENT DOCUMENTS

CN 103224188 A 7/2013
EP 0771756 A2 5/1997
(Continued)

OTHER PUBLICATIONS

European Search Report for application EP 18194586, dated Apr. 2, 2019, 9 pages.

*Primary Examiner* — Gene O Crawford
*Assistant Examiner* — Keith R Campbell
(74) *Attorney, Agent, or Firm* — Cantor Colburn LLP

(57) ABSTRACT

A conveyance element (20) for a people conveyor (1) is configured for being moved in a conveyance direction. The conveyance element (20) comprises a tread plate (24) configured for supporting passengers and at least one protection element (28, 29) configured for collecting items and/or fluids. The tread plate (24) has a longitudinal extension extending parallel to the conveyance direction and a lateral extension extending transversely to the conveyance direction. The at least one protection element (28, 29) is arranged below the tread plate (24), when the conveyance element (20) is arranged in an upright orientation, and it extends beyond at least one end (23) of the tread plate (24) in the conveyance direction.

18 Claims, 9 Drawing Sheets

(56) References Cited

U.S. PATENT DOCUMENTS

| | | | | |
|---|---|---|---|---|
| 7,204,361 | B2 * | 4/2007 | Illedits | B66B 23/12 198/326 |
| 7,275,634 | B1 | 10/2007 | Hinson | |
| 7,950,515 | B2 * | 5/2011 | Gonzalez Alemany | B66B 23/10 198/327 |
| 8,322,508 | B2 * | 12/2012 | Matheisl | B66B 23/12 198/326 |
| 8,381,895 | B2 * | 2/2013 | Howard | B66B 23/12 198/327 |
| 8,662,282 | B1 | 3/2014 | Withington et al. | |
| 9,718,647 | B2 * | 8/2017 | Makovec | B66B 21/10 |
| 2017/0297873 | A1 | 10/2017 | Turek | |

FOREIGN PATENT DOCUMENTS

| | | | | |
|---|---|---|---|---|
| EP | 0822918 | B1 | | 12/1999 |
| EP | 1680329 | A2 | | 9/2008 |
| EP | 2058264 | A1 | | 5/2009 |
| EP | 1597186 | B1 | | 6/2009 |
| EP | 1755999 | B1 | | 9/2009 |
| EP | 1716064 | B1 | | 5/2011 |
| EP | 2341028 | B2 | | 10/2013 |
| EP | 2546183 | B1 | | 4/2014 |
| EP | 3024771 | B1 | | 5/2017 |
| EP | 3044153 | B1 | | 6/2017 |
| EP | 3099617 | B1 | | 2/2018 |
| JP | H03143897 | A | | 6/1991 |
| JP | 04072290 | A | * | 3/1992 |
| JP | H0472290 | A | | 3/1992 |
| JP | 2008303054 | A | | 12/2008 |

* cited by examiner

CONVEYANCE ELEMENT FOR A PEOPLE CONVEYOR

FOREIGN PRIORITY

This application claims priority to European Patent Application No. 18194586.6, filed Sep. 14, 2018, and all the benefits accruing therefrom under 35 U.S.C. § 119, the contents of which in its entirety are herein incorporated by reference.

BACKGROUND

The invention relates to a conveyance element for a people conveyor such as an escalator or a moving walkway. The invention also relates to a people conveyor comprising such a conveyance element.

People conveyors usually comprise a plurality of conveyance elements, e.g. pallets or steps, at least some of which are drivingly coupled to at least one drive element, such as a drive belt or a drive chain. The conveyance elements form an endless conveyance band moving along an upper conveyance portion and a lower return portion. In turnaround portions at the ends of the people conveyor, the conveyance elements are transferred from the conveyance portion into the return portion and vice versa. In order to allow for a smooth movement of the conveyance elements, in particular in the turnaround portions, gaps are formed between adjacent conveyance elements.

Sun light, dust, rain or (melted) snow as well as objects and/or fluids dropped by passengers standing on the conveyance elements may pass through said gaps soiling or even damaging the at least one drive element.

It would be beneficial to provide improved conveyance elements which are capable of preventing the at least one drive element from being soiled or damaged.

SUMMARY

According to an exemplary embodiment of the invention, a conveyance element for a people conveyor, which is configured for being moved in a conveyance direction, comprises a tread plate configured for supporting passengers, and at least one protection element configured for protecting a drive element arranged below the conveyance element, in particular by blocking sunlight and/or by collecting items and/or fluids passing trough gaps formed between adjacent conveyance elements. The tread plate has a longitudinal extension extending parallel to the conveyance direction and a lateral extension extending transversely to the conveyance direction. The at least one protection element is arranged below the tread plate, when the conveyance element is arranged in an upright orientation, and extends beyond at least one end of the tread plate in the conveyance direction.

Exemplary embodiments of the invention also include a people conveyor comprising at least one drive element extending in a closed loop between two turnaround portions in a conveyance direction along a conveyance portion and a return portion. The people conveyor further comprises a plurality of conveyance elements according to an exemplary embodiment of the invention. At least some of, in particular all of, the plurality of conveyance elements are attached to the at least one drive element. The protection elements of the conveyance elements extend below gaps formed between the tread plates of two adjacent conveyance elements, when the conveyance elements are arranged in the conveyance portion.

The protection elements of the conveyance elements collect objects and/or fluids passing through the gaps formed between adjacent conveyance elements. This prevents the objects and/or fluids passing through the gaps from polluting the space below the conveyance portion of the people conveyor. The protection elements in particular prevent the objects and/or fluids passing through the gaps from contacting and thereby soiling or even damaging the at least one drive element of the people conveyor.

The protection elements further block sun light passing through the gaps from reaching the at least one drive element. Sun light, in particular the UV portion of sun light, may damage or deteriorate the at least one drive element, in particular when the at least one drive element includes a synthetic belt, such as a belt including polyurethane or a polyurethane coating.

Thus, the risk of additional downtime and/or increased costs for maintenance and/or repair of the people conveyor caused by objects and/or fluids passing through the gaps formed between adjacent conveyance elements may be reduced.

A number of optional features are set out in the following. These features may be realized in particular embodiments, alone or in combination with any of the other features.

The at least one protection element may be formed as a collector comprising a concavely shaped collection element, in particular a collection tray or a collection bin. A concavely shaped collection element, such as a collection tray or a collection bin, reliably accommodates the objects and/or fluids. It in particular prevents the objects and/or fluids from dropping out of the protection element due to the movement of the conveyance elements along the conveyance portion of the people conveyor.

The collection elements may be arranged in an inclined orientation with a lower end of the collection elements facing the conveyance element when the conveyance element is arranged in an upright orientation. An inclined orientation of the collection elements helps to prevent objects and/or fluids from dropping out of the protection element due to the movement of the conveyance elements along the conveyance portion of the people conveyor.

The at least one protection element may extend basically over the complete lateral extension of the tread plate in order to protect the space below the conveyance portion over its complete width from objects and/or fluids passing through the gap.

Alternatively, the at least one protection element may extend only over a fraction, in particular over not more than one half, more particularly over not more than one third or one quarter, of the lateral extension of the tread plate, while still extending over the complete lateral extension (width) of the at least one drive element. Reducing the width of the protection element may reduce the costs of the protection element.

The at least one protection element may be manufactured separately from the structural element and the tread plate and then mounted to the structural element and/or to the tread plate. Alternatively, the at least one protection element may be formed integrally with the structural element or integrally with the tread plate.

The at least one protection element may be mounted to the structural element and/or to the tread plate by means of screws, rivets, or similar fastening elements, and/or the at least one protection element may be welded or glued to the tread plate.

In an alternative configuration, the at least one protection element may be mounted to the at least one drive element.

The at least one protection element may be made of metal, in particular of aluminum, or a plastic material. The at least one protection element in particular may be made of a light material in order to minimize the additional weight added to the conveyance element by the at least one protection element.

The at least one protection element may comprise a front end facing away from the conveyance element. A sealing lip, in particular an elastic sealing lip, may be provided at said front end. In a people conveyor comprising a plurality of conveyance elements, the at least one sealing lip of each protection element may contact an adjacent conveyance element, at least when the conveyance elements are arranged in the conveyance portion.

Sealing lips provide a tight seal between each protection element and an adjacent conveyance element, respectively. Sealing lips further may compensate for varying distances between adjacent conveyance elements which may occur for example due to manufacturing tolerances and/or due to wear and/or thermal expansion and/or contraction of the at least one drive element.

Sealing lips also may reduce noise generated by the protection elements hitting against a structural element of an adjacent conveyance element during operation of the people conveyor/movement of the conveyance elements.

A people conveyor according to an embodiment of the invention may comprise at least one waste bin arranged below at least one of the turnaround portions in order to collect objects and/or fluids dropping out of the protection elements when the protection elements are turned upside down in the respective turnaround portion.

The at least one waste bin may be provided with a drain fluidly connected to a sewer in order to allow disposing fluids right away and preventing the risk of flooding the at least one waste bin, e.g. in case of heavy rain.

A people conveyor according to an embodiment of the invention may comprise at least two drive elements extending parallel to each other for providing redundancy and/or for splitting the driving forces between a plurality of drive elements.

The at least one drive element may be a drive chain or a drive belt.

The at least one drive element may be configured for traveling along a closed loop defining an endless path of the conveyance elements.

The people conveyor may be a moving walkway in which the conveyance elements are pallets. The moving walkway may extend horizontally or in an inclined direction.

Alternatively, the people conveyor may be an escalator in which the conveyance elements are steps.

DRAWING DESCRIPTION

In the following exemplary embodiments of the invention are described with reference to the enclosed figures.

DETAILED DESCRIPTION

Figure 1:
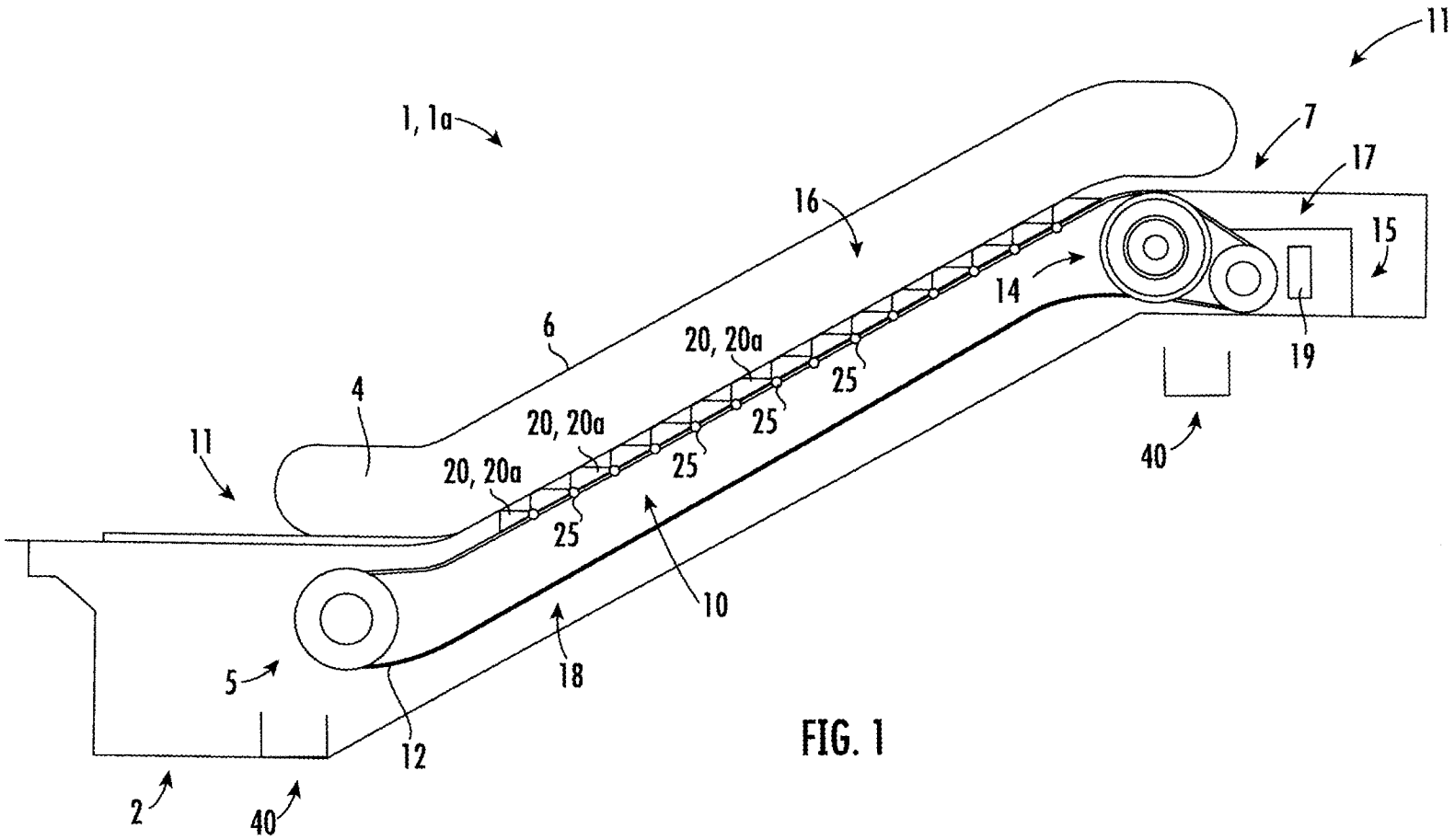
FIG. 1 depicts a schematic side view of a people conveyor, in particular of an escalator.

FIG. 1 depicts a schematic side view of a people conveyor 1, in particular of an escalator 1*a*, comprising a truss 2 and a conveyance band 10. The conveyance band 10 includes a plurality of conveyance elements 20 (steps 20*a*) and extends in a longitudinal conveyance direction between two landing portions 11. The conveyance elements 20 comprise rollers 25 guided and supported by guide rails (not shown). For clarity, only some of the conveyance elements 20 are depicted in FIG. 1, and not all conveyance elements 20/rollers 25 are provided with reference signs.

In turnaround portions 5, 7 next to the landing portions 11, the conveyance band 10 passes from an upper conveyance portion 16 into a lower return portion 18, and vice versa.

The conveyance elements 20 are connected to a drive element 12, such as a drive chain or a drive belt, extending along a closed loop and configured for driving the conveyance elements 20. The drive element 12 is driven by a conveyance sprocket or sheave 14. A drive 15 including a motor 19 is provided for driving the conveyance sprocket or sheave 14 via a transmission element 17, such as a transmission belt or a transmission chain.

Balustrades 4 supporting moving handrails 6 extend parallel to the conveyance portion 16.

Waste bins 40 may be arranged below the turnaround portions 5, 7 of the conveyance band 10. The functionality and advantages of such waste bins 40 will be discussed further below.

Figure 2:
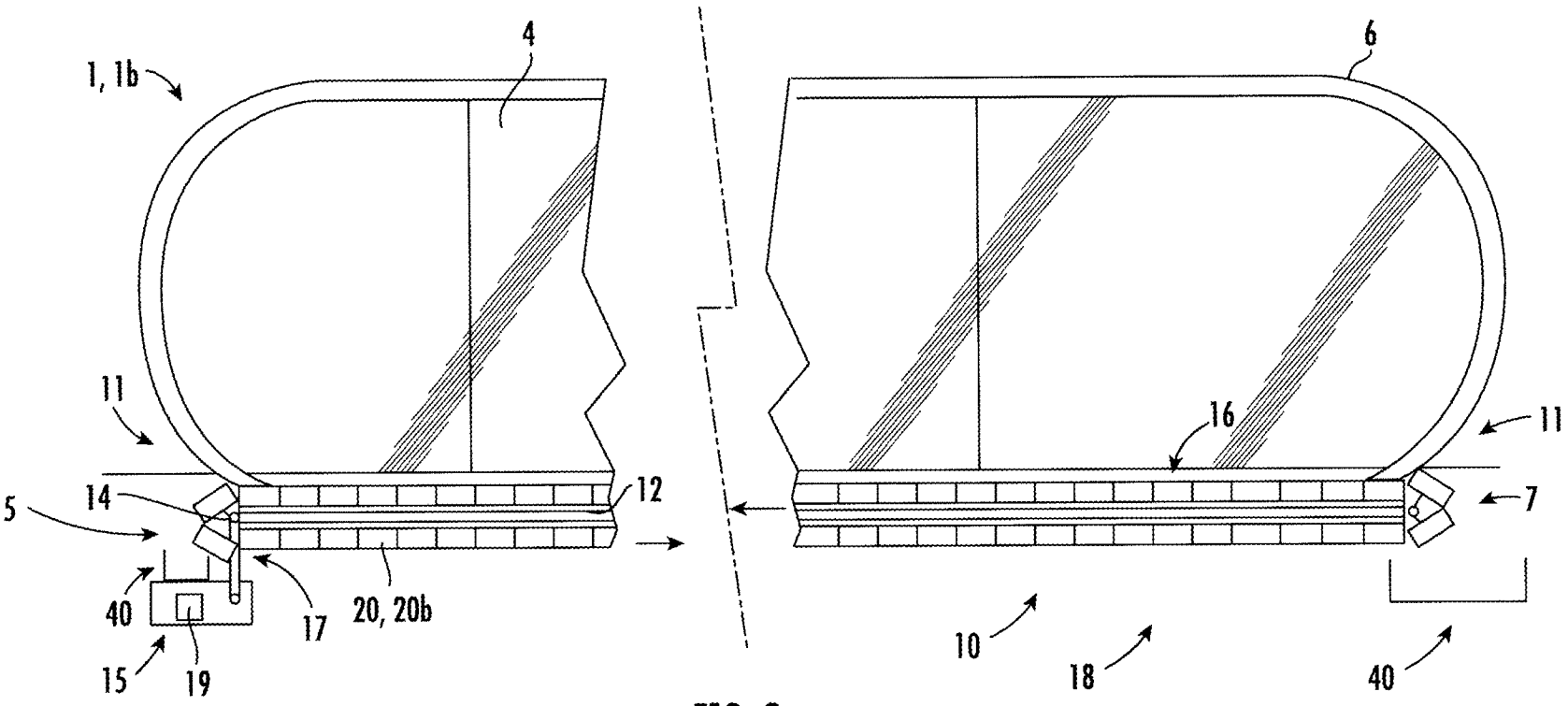
FIG. 2 depicts a schematic side view of another people conveyor, in particular of a moving walkway.

FIG. 2 schematically depicts a schematic side view of another people conveyor 1, in particular of a moving walkway 1*b*.

The moving walkway 1*b* comprises an endless conveyance band 10 including conveyance elements 20 (pallets 20*b*) moving between two landing portions 11 in a conveyance direction in an upper conveyance portion 16 and opposite to the conveyance direction in a lower return portion 18. Turnaround portions 5, 7, are provided at both ends of the moving walkway 1*b*. In the turnaround portions 5, 7 the conveyance band 10 passes from the conveyance portion 16 into the return portion 18, and vice versa.

The conveyance elements 20 are connected to a drive element 12, such as a drive chain or a drive belt, extending along a closed loop and configured for driving the conveyance elements 20. The drive element 12 is driven by a conveyance sprocket or sheave 14. A drive 15 including a motor 19 is provided for driving the conveyance sprocket or sheave 14 via a transmission element 17, e.g. a transmission belt or a transmission chain.

Balustrades 4 supporting moving handrails 6 extend parallel to the conveyance portion 16.

Waste bins 40 may be arranged below the turnaround portions 5, 7 of the conveyance band 10. The functionality and advantages of such waste bins 40 will be discussed further below.

Figure 3:
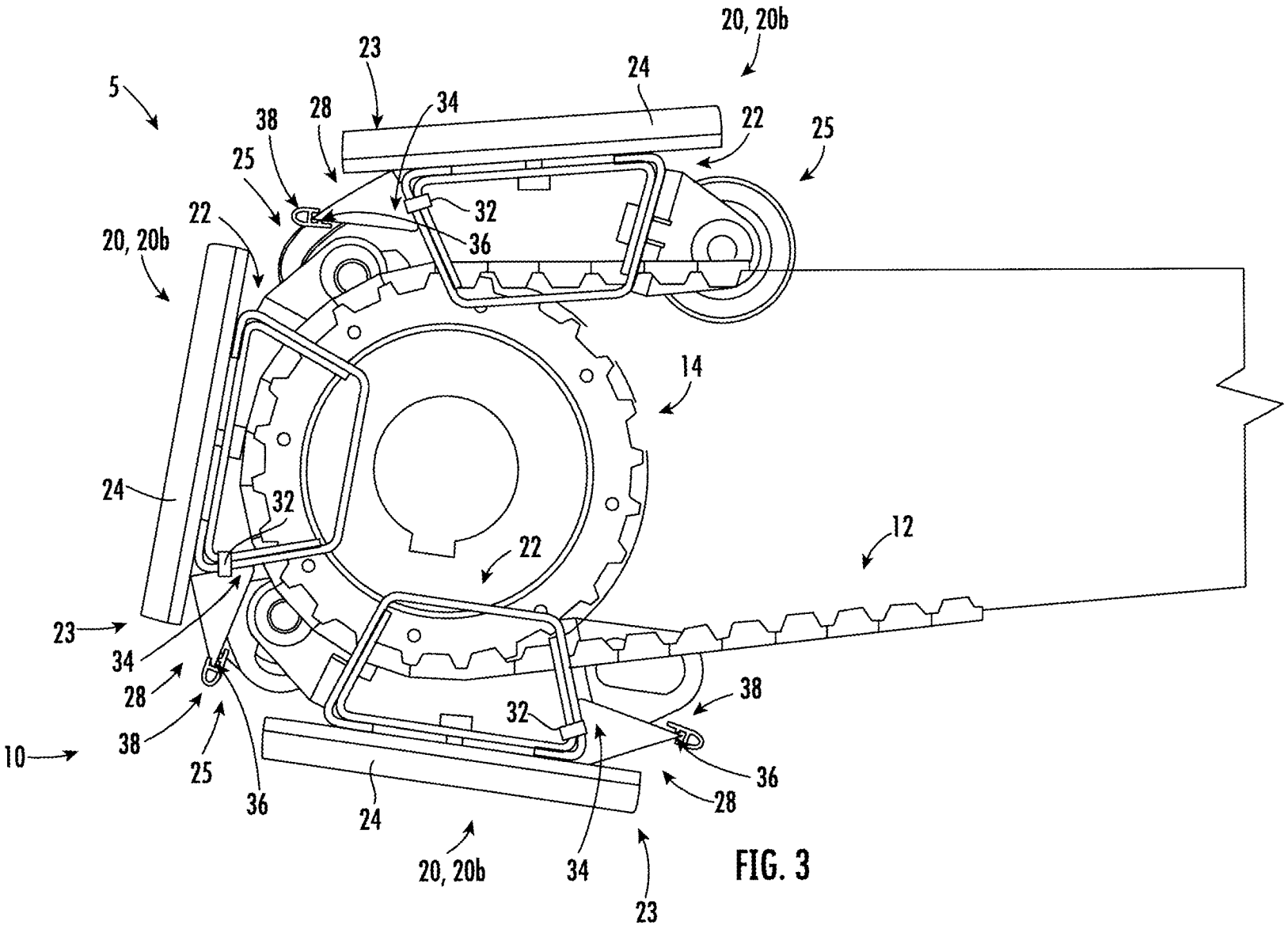
FIG. 3 depicts a sectional side view of a section of a conveyance band of a people conveyor comprising a plurality of conveyance elements according to an exemplary embodiment of the invention in a turnaround portion of a people conveyor.

FIG. 3 depicts a sectional side view of a section of a conveyance band 10 of a moving walkway 1*b* (cf. FIG. 2) comprising a plurality of conveyance elements (pallets 20*b*) according to an exemplary embodiment of the invention in a turnaround portion 5 of the moving walkway 1*b*.

Figure 4:
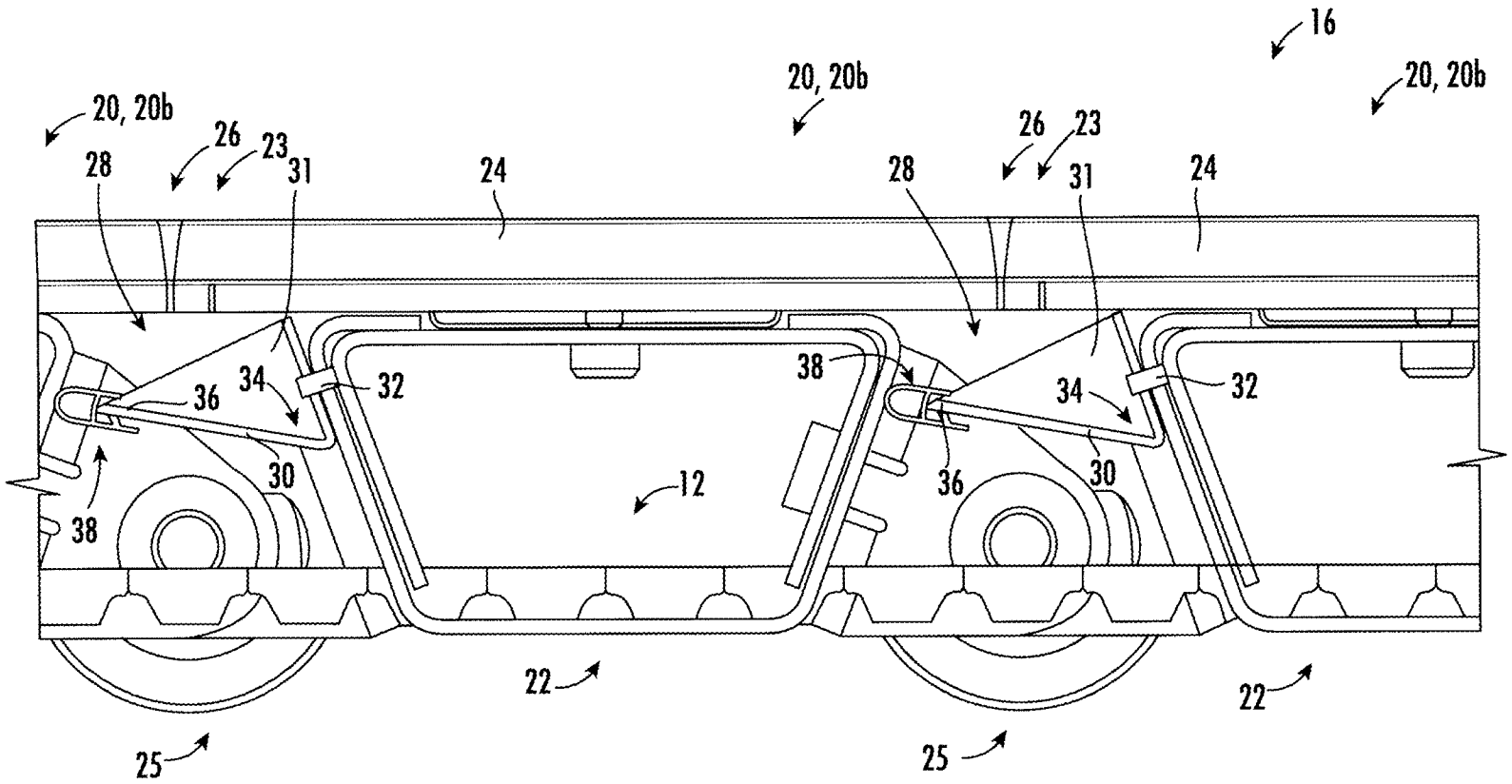
FIG. 4 depicts a section of the conveyance band shown in FIG. 3 in a conveyance portion of a people conveyor.

FIG. 4 depicts a section of the same conveyance band 10 in the conveyance portion 16 of the moving walkway 1*b*.

The conveyance band 10 comprises at least one drive element 12, which in the embodiment depicted in the figures is a belt, e.g. a polyurethane coated belt, and a plurality of conveyance elements 20 attached to the at least one drive element 12.

In the turnaround portion 5 depicted in FIG. 3, the at least one drive element 12 is in engagement with a sprocket or sheave 14.

Each of the conveyance elements 20 comprises a structural element 22 attached to the at least one drive element 12 and a tread plate 24 supported by the structural element 22. The tread plate 24 is configured for supporting passengers (not shown) using the people conveyor 1.

Each conveyance element 20 further comprises at least one roller 25. The rollers 25 are supported and guided by guide rails (not shown) defining the path of the conveyance elements 20.

In order to allow for a smooth and unobstructed movement of the conveyance elements 20, in particular in the turnaround portions 5, 7, the dimensions of the tread plates 24 in the longitudinal conveyance direction are set so that small gaps 26 are formed between adjacent tread plates 24, when the conveyance elements 20 are arranged in the conveyance portion 16 of the people conveyor 1 (see FIG. 4).

Objects, such as dust/dirt, and/or fluids dropped by the passengers standing on the tread plates 24 may pass through said gaps 26 soiling the space and the components of the people conveyor 1 below the conveyance portion 16. The objects and/or fluids in particular may come in contact with the at least one drive element 12. The objects and/or fluids contacting the at least one drive element 12 may damage or at least deteriorate the at least one drive element 12 causing reduced performance and/or increased energy consumption of the people conveyor 1. This may result in additional downtime and/or increased costs for maintenance and/or repair.

In a people conveyor 1 according to an exemplary embodiment of the invention, the conveyance elements 20 comprise protection elements (collectors) 28 which are configured for protecting the at least one drive element 12 by blocking sun light and collecting any objects and/or fluids passing through the gaps 26 in order to avoid any problems caused by objects and/or fluids passing through the gaps 26 and contacting the at least one drive element 12.

Figure 5:
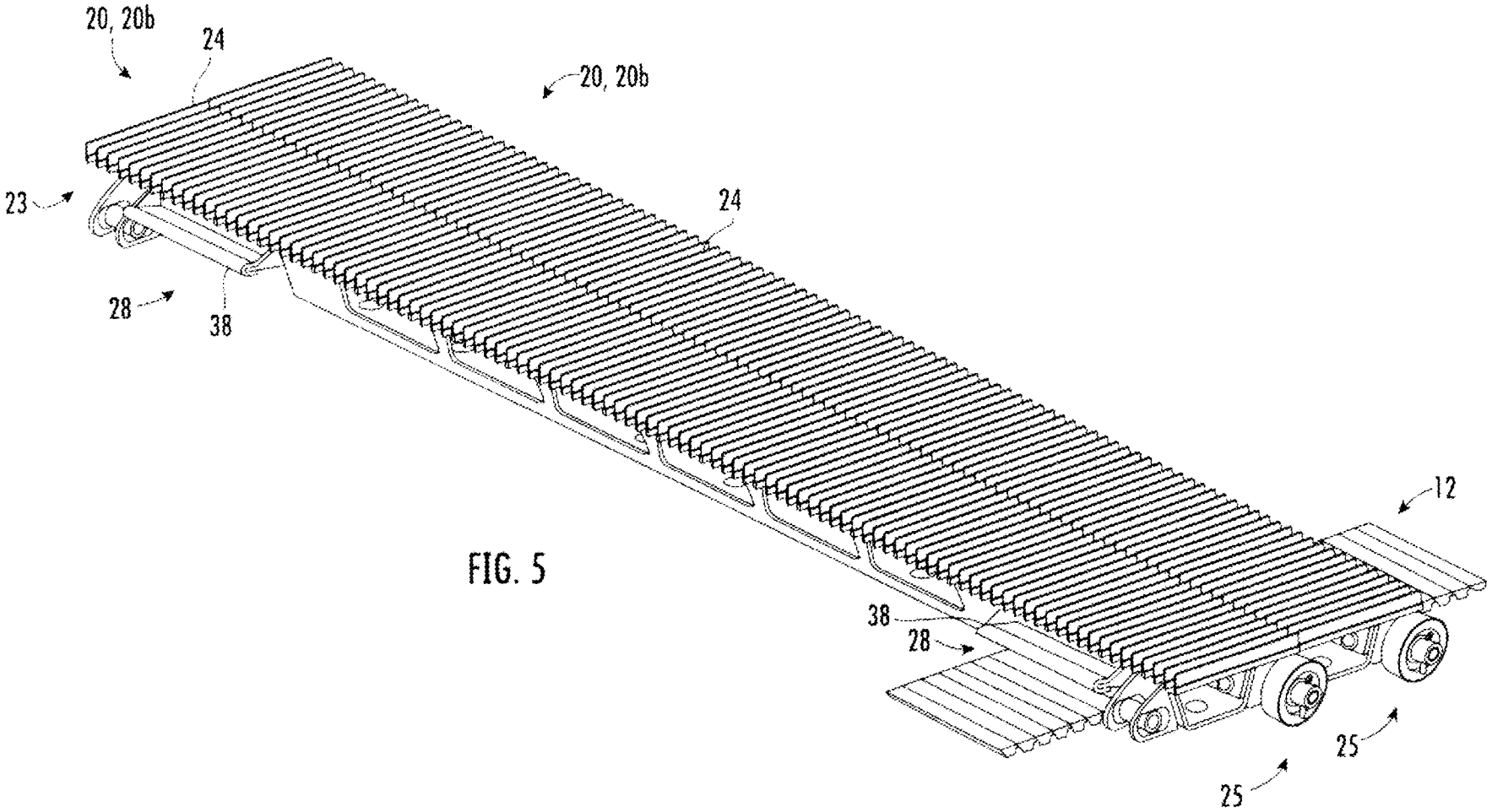
FIG. 5 depicts a perspective view of two adjacent conveyance elements according to an exemplary embodiment of the invention.

FIG. 5 shows a perspective view of two adjacent conveyance elements 20 respectively comprising two protection elements 28. The protection elements 28 of the conveyance element 20 depicted on the right side of FIG. 5 are not visible as they are covered by the tread plate 24 of the conveyance element 20 depicted on the left side of FIG. 5.

The conveyance elements 20 depicted in FIG. 5 are configured to be driven by two conveyance elements (belts) 12 extending parallel to each other along the longitudinal conveyance direction. Only one of said conveyance elements 12 is shown in FIG. 5.

Figure 6:
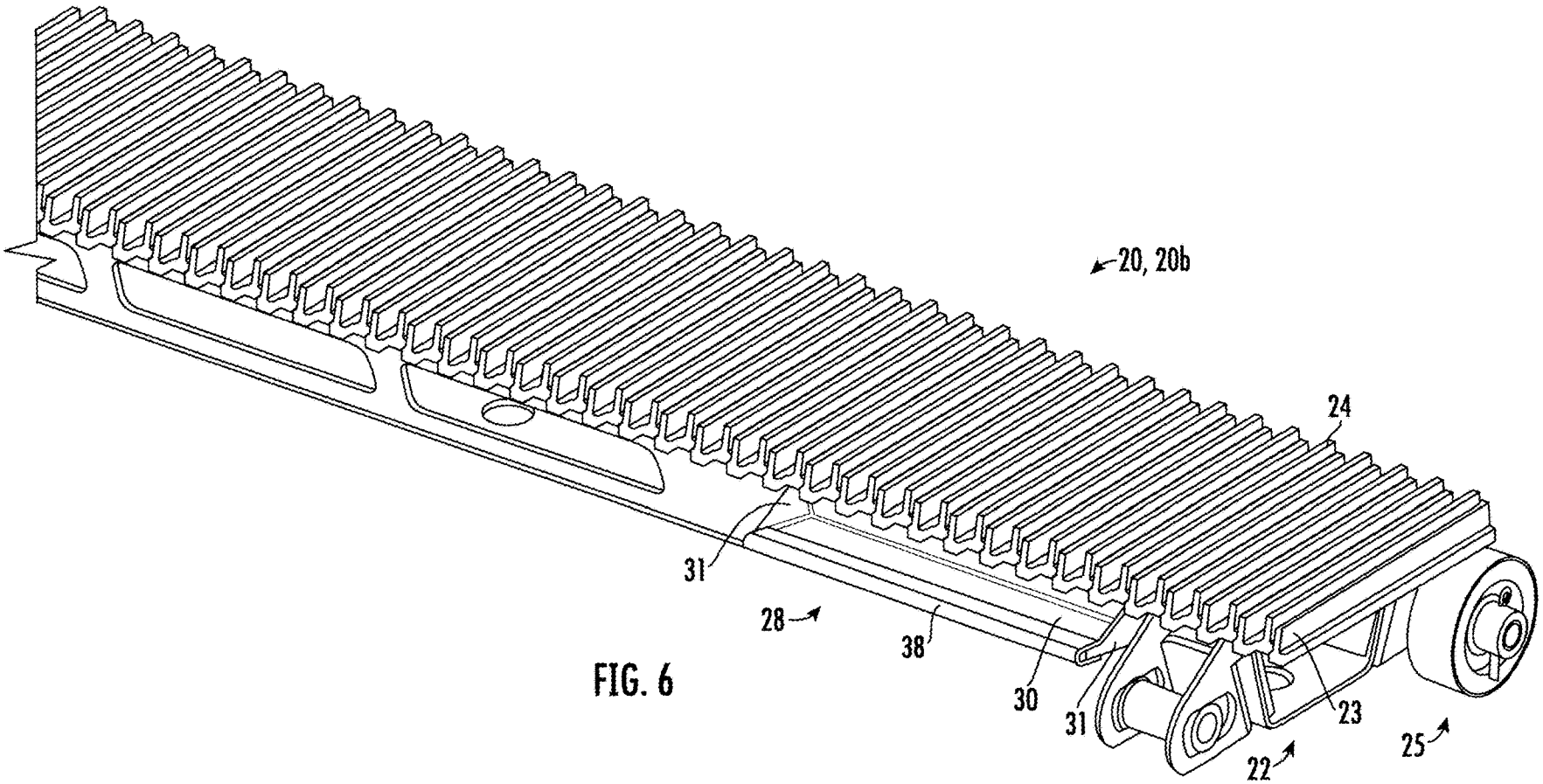
FIGS. 6 and 7 depict enlarged perspective views of a portion of a conveyance element as it is shown in FIG. 5, respectively.
Figure 7:
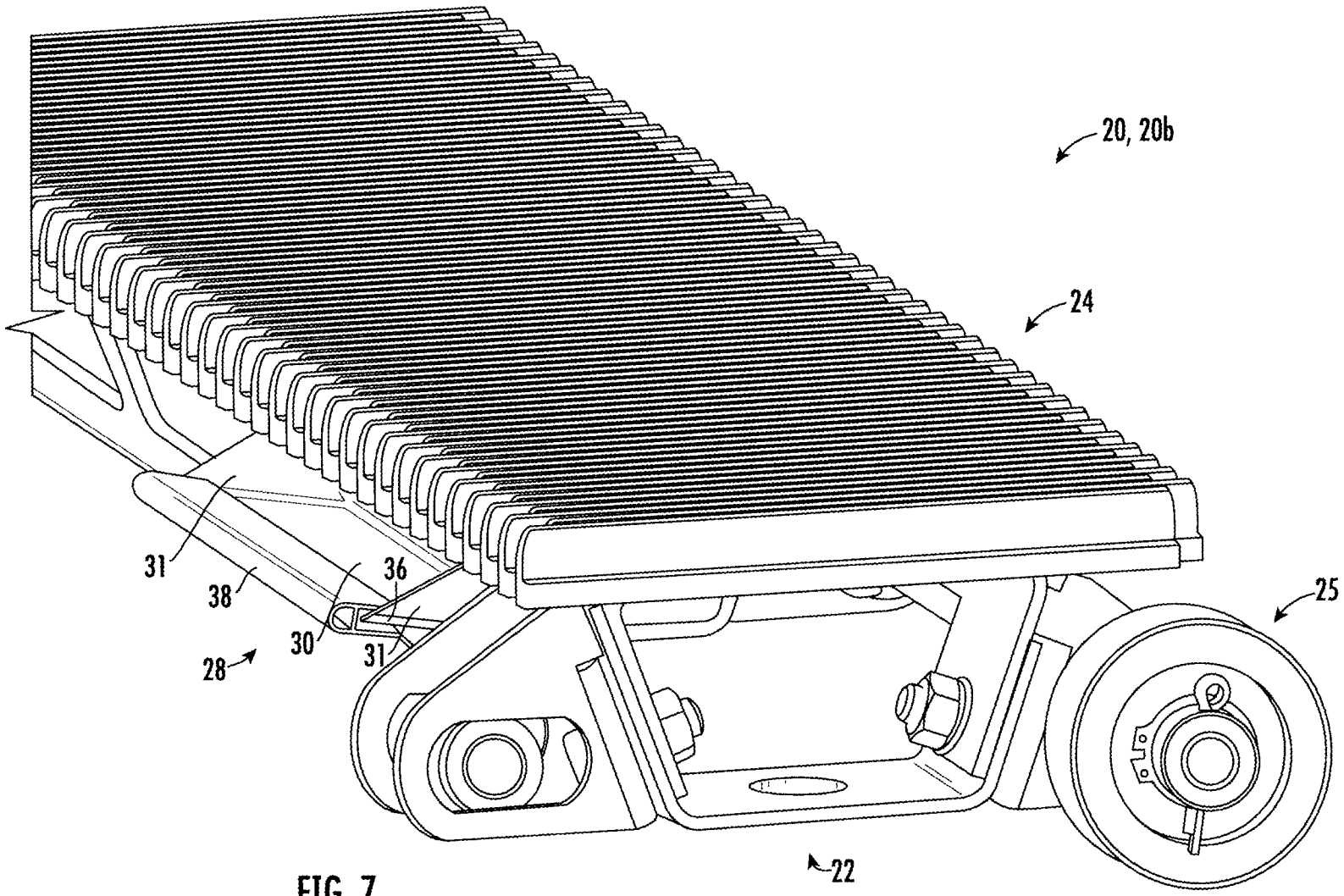

FIGS. 6 and 7 depict enlarged perspective views of a portion of a conveyance element 20 as shown in FIG. 5. The at least one drive element 12 is not shown in FIGS. 6 and 7.

The protection element 28 comprises a concave collection element 30 such as a collection bin or a collection tray. The collection element 30 extends below the tread plate 24 in a longitudinal direction oriented parallel to the conveyance direction, i.e. parallel to the at least one drive element 12, and in a lateral direction oriented transversely, in particular orthogonally, to the conveyance direction and to the extension of the at least one drive element 12. In the longitudinal direction, the collection element 30 extends beyond an end 23 of the tread plate 24 (see also FIGS. 3 and 4).

As best visible in FIG. 4, the protection elements 28 extend below the gaps 26 formed between adjacent conveyance elements 20, when the conveyance elements 20 are arranged in the conveyance portion 16 of the moving walkway 1*b*. In consequence, objects and/or fluids passing through the gaps 26 drop into the protection elements 28 instead of dropping onto the at least one drive element 12.

The protection element 28 further comprises two sidewalls 31 extending basically vertically from the lateral ends of the collection element 30. In the embodiment shown in FIGS. 6 and 7, the sidewalls 31 have a triangular shape, respectively. In alternative embodiments not depicted in the figures, the sidewalls 31 may have alternative shapes, such as rectangular shapes or curved shapes. The sidewalls 31 prevent objects and/or fluids collected within the protection element 28 from laterally dropping out of the collection element 30.

When the protection elements 28 are turned upside down in one of the turnaround portions 5, 7 (cf. FIG. 3), the objects and/or fluids collected within the protection elements 28 drop out of the protection elements 28. The objects and/or fluids in particular may drop into waste bins 40 arranged below the turnaround portions 5, 7 of the conveyance band 10 (see FIG. 2) in order to allow for an easy disposal.

Optionally, the waste bins 40 may be provided with a drain (not shown) fluidly connected to a sewer in order to allow disposing fluids right away and preventing the risk of flooding the waste bins 40, e.g. in case of heavy rain dropping onto the people conveyor 1.

The protection elements 28 also block sun light passing through the gaps 26 from reaching the at least one drive element 12. Sun light, in particular the UV portion of sun light, may damage or deteriorate the at least one drive element 12, in particular when the at least one drive element 12 includes a synthetic belt, such as a belt including polyurethane or a polyurethane coating.

When the conveyance element 20 is arranged in the conveyance portion 16 of the people conveyor 1, the collection element 30 is arranged in an inclined orientation with a lower end 34 of the collection element 30 arranged at the side of the protection element 28 facing the structural element 22 of the conveyance element 20 (cf. FIG. 4). As a result, objects and/or fluids collected within the collection element 30 accumulate at said lower end 34. Accumulating the objects and/or fluids in a lower portion of the protection element 28 prevents the objects and/or fluids from falling out of the protection element 28 while moving along the conveyance portion 16.

A sealing lip 38, which may be made of an elastic material such as rubber or plastic, is mounted to a front end 36 of the collection element 30 facing away from the structural element 22. As shown in FIG. 4, the sealing lip 38 of each conveyance element 20 abuts against the structural element 22 of an adjacent conveyance element 20, when the conveyance elements 20 are arranged in the conveyance portion 16 of the people conveyor 1.

The sealing lips 38 provide seals between each protection element 28 and an adjacent conveyance element 20. The sealing lips 38 also compensate for varying distances between adjacent conveyance elements 20 as they may occur for example due to manufacturing tolerances and/or due to wear and/or thermal expansion/contraction of the at least one drive element 12.

The sealing lips 38 also reduce the noise generated when the protection elements 28 hit against the structural element 22 of the adjacent conveyance element 20 during operation of the people conveyor 1.

The protection elements 28 may be made of metal, such as aluminum, or a suitable plastic material. The protection elements 28 in particular may be made of a light material in order to reduce the additional weight added to the conveyance elements 20 by the protection elements 28.

The protection elements 28 may be mounted to the structural elements 22 and/or to the tread plates 24 of the conveyance elements 20, e.g. by means of screws, rivets or similar fastening elements 32 (see FIGS. 3 and 4). Alternatively or additionally, the protection elements 28 may be welded or glued to the structural elements 22 and/or to the tread plates 24. The protection elements 28 also may be formed integrally with the structural elements 22 and/or the tread plates 24 of the conveyance elements 20.

In an alternative configuration, which is not depicted in the figures, the at least one protection element 28 is mounted to the at least one drive element 12.

In the embodiments depicted in FIGS. 5 to 7, each protection element 28 extends only over a portion of the lateral extension (width) but not over the total width of the conveyance element 20. The lateral extension of each protection element 28 in particular basically corresponds to the lateral extension (width) of the at least one drive element 12, so that the protection element 28 covers the at least one drive element 12 over its complete width. In configurations comprising two, or more, parallel extending drive elements 12, each conveyance element 20 may be provided with two, or more, protection elements 28 (cf. FIG. 5), each protection element 28 extending over one of the drive elements 12, respectively.

Figure 8:
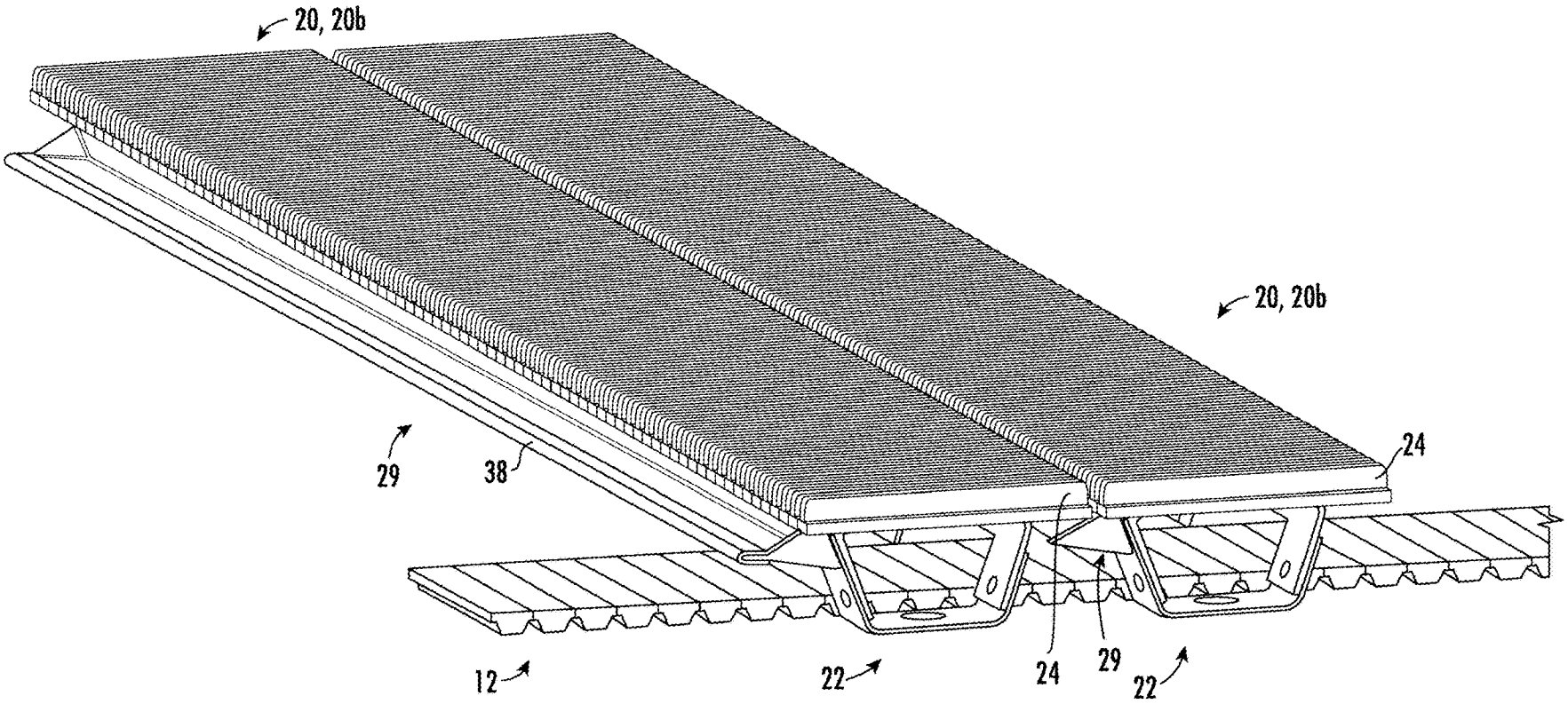
FIG. 8 depicts a perspective view of two conveyance elements according to another exemplary embodiment of the invention.
Figure 9:
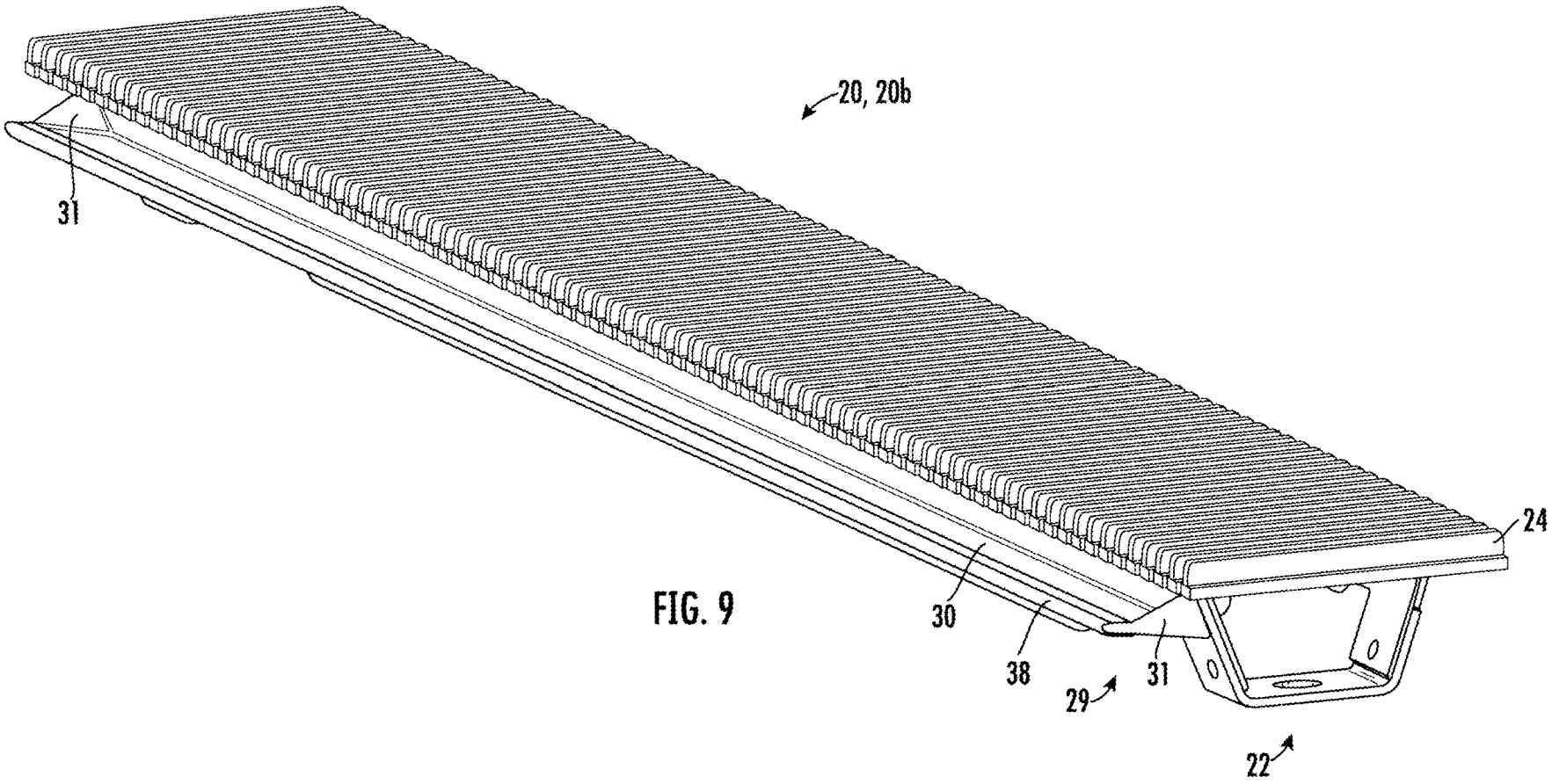
FIG. 9 depicts an enlarged perspective view of a portion of a conveyance element as it is shown in FIG. 8

An alternative configuration, which also represents an exemplary embodiment of the invention, is depicted in FIGS. 8 and 9.

In said alternative configuration, each conveyance element 20 comprises a single protection element 29 extending basically over the complete lateral extension (width) of the tread plate 24. As a result, the single protection element 29 covers two, or even more, drive elements 12 extending below the conveyance element 20.

Except for its different lateral extension, the structure of the single protection element 29 corresponds to the structure of the protection elements 28 described before and therefore is it is not discussed in detail again.

A single protection element 29 extending basically over the complete lateral extension (width) of the conveyance element 20/tread plate 24 not only protects the at least one drive element 12 from objects, fluids and/or sunlight passing through the gaps 24, it further prevents the complete space and all components arranged below the conveyance portion 16 of the conveyance band 10 from being soiled by objects and/or fluids passing through the gaps 26. As a result, the cost for maintenance, in particular for cleaning, of the people conveyor 1 may be reduced even further.

Although exemplary embodiments of the invention have been described with respect to a moving walkway 1*b* in which the conveyance elements 20 are pallets 20*b*, the skilled person understands that the invention may be applied equivalently to escalators 1*a* comprising steps 20*a* instead of pallets 20*b*.

Further, the invention may be applied to people conveyors 1 in which the at least one drive element 12 is a chain instead of a belt.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

1 people conveyor
1*a* escalator
1*b* moving walkway
2 truss
4 balustrade
5 turnaround portion
6 handrail
7 turnaround portion
10 conveyance band
11 landing portion
12 drive element
14 sprocket/sheave
15 drive
16 conveyance portion
17 transmission element
18 return portion
19 motor
20 conveyance element
20*a* step
20*b* pallet
22 structural element
23 end of the tread plate
24 tread plate
25 roller
26 gap
28 protection element
29 single protection element
30 collection element
31 sidewall
32 fastening element
34 lower end of the collection element
36 front end of the collection element
38 sealing lip
40 waste bin

What is claimed is:

1. Conveyance element for a people conveyor, wherein the conveyance element is configured for being moved in a conveyance direction;

wherein the conveyance element comprises a tread plate configured for supporting passengers, the tread plate having a longitudinal extension extending parallel to the conveyance direction and a lateral extension extending transversely to the conveyance direction;

wherein the conveyance element further comprises at least one protection element configured for collecting items and/or fluids;

wherein the at least one protection element extends beyond at least one end of the tread plate in the conveyance direction and is arranged below the tread plate, when the conveyance element is arranged in an upright orientation;

wherein the at least one protection element extends only over a fraction of the tread plate along the lateral extension of the tread plate.

2. Conveyance element according to claim 1, wherein the at least one protection element comprises a concavely shaped collection element.

3. Conveyance element according to claim 2, wherein the collection element is arranged in an inclined orientation with a lower end of the collection element facing the conveyance element when the conveyance element is arranged in an upright orientation.

4. Conveyance element according to claim 2, wherein the concavely shaped collection element comprises a collection tray or a collection bin.

5. Conveyance element according to claim 1, wherein the at least one protection element extends over the lateral extension of the tread plate.

6. Conveyance element according to claim 1, wherein the at least one protection element is formed integrally with the tread plate or integrally with a structural element of the conveyance element.

7. Conveyance element according to claim 1, wherein the at least one protection element is mounted to the tread plate and/or to a structural element of the conveyance element.

8. Conveyance element according to claim 1, wherein the at least one protection element is made of metal or a plastic material.

9. People conveyor comprising:

at least one drive element extending in a closed loop between two turnaround portions (5, 7) in a conveyance direction along a conveyance portion and a return portion;

a plurality of conveyance elements according to claim 1, wherein at least two of the plurality of conveyance elements are attached to the at least one drive element so that the protection elements of the conveyance elements extend below gaps formed between the tread plates of two adjacent conveyance elements of the plurality of conveyance elements, when the conveyance elements are arranged in the conveyance portion.

10. People conveyor according to claim 9, comprising at least one waste bin arranged below at least one of the turnaround portions (5, 7).

11. People conveyor according to claim 9, wherein the at least one drive element is a drive chain or a drive belt.

12. People conveyor according to claim 9, comprising at least two drive elements extending parallel to each other.

13. People conveyor according to claim 9, wherein the people conveyor is an escalator (1a) and the conveyance elements are steps, or wherein the people conveyor is a moving walkway and the conveyance elements are pallets.

14. Conveyance element according to claim 1 wherein the at least one protection element extends over not more than one half of the lateral extension of the tread plate.

15. Conveyance element according to claim 1 wherein the at least one protection element extends over not more than one third of the lateral extension of the tread plate.

16. Conveyance element according to claim 1 wherein the at least one protection element extends over not more than one quarter of the lateral extension of the tread plate.

17. Conveyance element for a people conveyor, wherein the conveyance element is configured for being moved in a conveyance direction;

wherein the conveyance element comprises a tread plate configured for supporting passengers, the tread plate having a longitudinal extension extending parallel to the conveyance direction and a lateral extension extending transversely to the conveyance direction;

wherein the conveyance element further comprises at least one protection element configured for collecting items and/or fluids;

wherein the at least one protection element extends beyond at least one end of the tread plate in the conveyance direction and is arranged below the tread plate, when the conveyance element is arranged in an upright orientation;

wherein the at least one protection element comprises a front end facing away from the conveyance element with a sealing lip provided at said front end.

18. People conveyor comprising:

at least one drive element extending in a closed loop between two turnaround portions (5, 7) in a conveyance direction along a conveyance portion and a return portion;

a plurality of conveyance elements according to claim 17, wherein at least two of the plurality of conveyance elements are attached to the at least one drive element so that the protection elements of the conveyance elements extend below gaps formed between the tread plates of two adjacent conveyance elements of the plurality of conveyance elements and wherein the at least one sealing lip of each of the at least one protection element contacts an adjacent conveyance element of the plurality of conveyance elements, when the conveyance elements are arranged in the conveyance portion.

* * * * *